US012227387B2

(12) United States Patent
Tung et al.

(10) Patent No.: US 12,227,387 B2
(45) Date of Patent: Feb. 18, 2025

(54) AUTOMATIC DOCUMENT FEEDING DEVICE

(71) Applicant: KINPO ELECTRONICS, INC., New Taipei (TW)

(72) Inventors: Ya-Ching Tung, New Taipei (TW); Po-Chih Chang, New Taipei (TW)

(73) Assignee: KINPO ELECTRONICS, INC., New Taipel (TW)

( * ) Notice: Subject to any disclaimer, the term of this patent is extended or adjusted under 35 U.S.C. 154(b) by 162 days.

(21) Appl. No.: 18/091,067

(22) Filed: Dec. 29, 2022

(65) Prior Publication Data

US 2024/0132312 A1 Apr. 25, 2024
US 2024/0228206 A9 Jul. 11, 2024

(30) Foreign Application Priority Data

Oct. 20, 2022 (CN) ..... 202222766338.0

(51) Int. Cl.
*B65H 9/00* (2006.01)
*B65H 5/06* (2006.01)
*B65H 7/20* (2006.01)

(52) U.S. Cl.
CPC ..... *B65H 9/004* (2013.01); *B65H 5/062* (2013.01); *B65H 7/20* (2013.01);
(Continued)

(58) Field of Classification Search
CPC ..... B65H 5/06; B65H 5/062; B65H 9/004; B65H 9/04; B65H 9/06; B65H 2301/5121;
(Continued)

(56) References Cited

U.S. PATENT DOCUMENTS 4,958,199 A * 9/1990 Yamashita ..... G03G 15/6564 399/394
5,233,400 A * 8/1993 Cahill ..... G03G 15/6564 271/245
(Continued)

OTHER PUBLICATIONS

Search Report dated Feb. 9, 2024 of the corresponding European patent application No. 23193355.7.

*Primary Examiner* — Prasad V Gokhale
(74) *Attorney, Agent, or Firm* — Chun-Ming Shin; HDLS IPR SERVICES

(57) ABSTRACT

An automatic document feeding device having a main body, a stopping assembly, an actuating assembly and a controller. The main body has a sheet conveying channel of a curvature shape. A sheet feeding roller assembly and a sheet conveying roller assembly are arranged on the sheet conveying channel. The stopping assembly is arranged between the sheet feeding roller assembly and the sheet conveying roller assembly. The stopping assembly is capable of being located in or out of the sheet conveying channel. A buffering channel is located between the stopping assembly and the sheet feeding roller assembly. The controller is electrically connected with the actuating assembly and the sheet feeding roller assembly. The controller controls the actuating assembly to hold the stopping assembly in the sheet conveying channel to block the sheet conveying channel in a predetermined period, and then controls the actuating assembly to stop holding the stopping assembly.

13 Claims, 14 Drawing Sheets

(52) U.S. Cl.
CPC ..... *B65H 2301/512125* (2013.01); *B65H 2403/725* (2013.01); *B65H 2404/725* (2013.01); *B65H 2801/12* (2013.01)

(58) Field of Classification Search
CPC ..... B65H 2301/51212; B65H 2301/512125; B65H 2404/725; B65H 2403/725; B65H 2801/12
See application file for complete search history.

(56) References Cited

U.S. PATENT DOCUMENTS

| | | | | |
|---|---|---|---|---|
| 6,585,439 | B2 * | 7/2003 | Johnson | B41J 11/0055 400/637 |
| 9,027,923 | B2 | 5/2015 | Suzuki | |
| 2011/0006473 | A1 * | 1/2011 | Otaka | B65H 9/004 271/244 |
| 2012/0235350 | A1 | 9/2012 | Watanabe et al. | |
| 2015/0284199 | A1 * | 10/2015 | Kaiga | B65H 9/006 271/3.2 |

* cited by examiner

AUTOMATIC DOCUMENT FEEDING DEVICE

BACKGROUND OF THE DISCLOSURE

Technical Field

This disclosure is directed to an automatic document feeding device and in particular to an automatic document feeding device capable of correcting a skew of a sheet being fed.

Description of Related Art

According to a related-art automatic document feeding device, a skew correction mechanism thereof has a correction roller with a clutch for an operation cooperating with a blocking arm. When feeding a sheet, the correction roller is firstly retreated from a sheet conveying path and the sheet is conveyed to pass the correction roller. A stopping arm stops the sheet at a position behind the correction roller so as to align the paper, the correction roller is then restored to clamp the corrected sheet, and the stopping arm is meanwhile retreated from the sheet conveying path to allow correction roller to continually convey the paper. According to the related-art automatic document feeding device, independent motors are required for precisely actuating the stopping arm, a clutching motion of the correction roller, and a rotational feeding of the sheet respectively, and the respective mechanisms are complicated and operations are unstable.

In view of the above drawbacks, the inventor proposes this disclosure based on his expert knowledge and elaborate researches in order to solve the problems of related art.

SUMMARY OF THE DISCLOSURE

This disclosure is directed to an automatic document feeding device capable of correcting a skew of a sheet being fed.

This disclosure is directed to an automatic document feeding device having a main body, a sheet feeding roller assembly, a sheet conveying roller assembly, a stopping assembly, an actuating assembly and a controller. The main body has a sheet conveying channel disposed therein, the sheet conveying channel is of a curvature shape, a portion of the sheet conveying channel is expanded to form a buffering channel. The sheet feeding roller assembly and the sheet conveying roller assembly are respectively arranged at two positions of the sheet conveying channel. The stopping assembly is arranged between the sheet feeding roller assembly and the sheet conveying roller assembly and adjacent to the sheet conveying roller assembly. The stopping assembly is movably disposed on the main body and capable of being located in the sheet conveying channel or out of the sheet conveying channel, and the buffering channel is located between the stopping assembly and the sheet feeding roller assembly. The actuating assembly is arranged on the main body corresponding to the stopping assembly and capable of moving, holding or releasing the stopping assembly. The controller is electrically connected with the actuating assembly and the sheet feeding roller assembly. After the controller actuates the sheet feeding roller assembly, the controller controls the actuating assembly to hold the stopping assembly in the sheet conveying channel so as to block the sheet conveying channel in a predetermined period, and then controls the actuating assembly to stop the stopping assembly from blocking the sheet conveying channel.

According to an embodiment of this disclosure, the actuating assembly further has an elastic restoring member arranged on the stopping assembly, the elastic restoring member presses on the stopping assembly, and the stopping assembly is pushed to restore to the sheet conveying channel by the elastic restoring member after the stopping assembly leaves (or withdraws from) the sheet conveying channel.

According to an embodiment of this disclosure, the actuating assembly further has a gravity restoring member arranged on the stopping assembly, and the stopping assembly is pushed to restore to the sheet conveying channel by the gravity restoring member after the stopping assembly leaves the sheet conveying channel.

According to an embodiment of this disclosure, the sheet conveying channel has a sheet entrance disposed at one end thereof, the sheet feeding roller assembly is disposed between the sheet entrance and the buffering channel.

According to an embodiment of this disclosure, the main body has a tray connected with the sheet entrance.

According to an embodiment of this disclosure, the buffering channel is disposed at a convex side of the sheet conveying channel.

According to an embodiment of this disclosure, the sheet conveying roller assembly is disposed below the sheet feeding roller assembly, and a vertical position of the stopping assembly is between the sheet feeding roller assembly and the sheet conveying roller assembly.

According to an embodiment of this disclosure, the sheet feeding roller assembly has a feeding driving roller and an idle roller adjacent to each other and respectively disposed at two sides of the sheet conveying channel, and the feeding driving roller is disposed at a concave side of the sheet conveying channel.

According to an embodiment of this disclosure, the sheet conveying roller assembly has a conveying driving roller and an idle roller adjacent to each other and respectively disposed at two sides of the sheet conveying channel, and the conveying driving roller is disposed at a concave side of the sheet conveying channel.

According to an embodiment of this disclosure, the stopping assembly has a plurality of the stoppers capable of being inserted into the sheet conveying channel, a calibration reference line is defined by an arrangement of the stoppers in the sheet conveying channel when the stoppers are located in the sheet conveying channel, and the calibration reference line is perpendicular to a longitudinal direction of the sheet conveying channel.

According to an embodiment of this disclosure, the stopping assembly is predeterminedly located in the sheet conveying channel, the controller controls the actuating assembly to hold and latch the stopping assembly in the sheet conveying channel for a predetermined period, and then controls the actuating assembly to release the stopping assembly.

According to an embodiment of this disclosure, the stopping assembly is predeterminedly located outside the sheet conveying channel, the controller controls the actuating assembly to move the stopping assembly into the sheet conveying channel and hold the stopping assembly in the sheet conveying channel for a predetermined period, and then controls the actuating assembly to release the stopping assembly.

According to an embodiment of this disclosure, the controller controls the actuating assembly to hold the stopping assembly in the sheet conveying channel for a predetermined period, and then controls the actuating assembly to move the stopping assembly out of sheet conveying channel.

According to an embodiment of this disclosure, the stopping assembly is disposed at a concave side of the sheet conveying channel.

According to the automatic document feeding device of this disclosure, the stopping assembly is arranged between the sheet feeding roller assembly and the sheet conveying roller assembly and adjacent to the sheet conveying roller assembly. The controller controls the actuating assembly to hold the stopping assembly for a predetermined period after the controller actuates the sheet feeding roller assembly, and the actuating assembly then releases the stopping assembly. Accordingly, a feeding process and a correction action of the mechanism are controlled together, so that a skew of a sheet being fed may be stably corrected via a simple mechanism.

BRIEF DESCRIPTION OF THE DRAWINGS

The features of the disclosure believed to be novel are set forth with particularity in the appended claims. The disclosure itself, however, may be best understood by reference to the following detailed description of the disclosure, which describes a number of exemplary embodiments of the disclosure, taken in conjunction with the accompanying drawings, in which:

DETAILED DESCRIPTION

Figure 1:
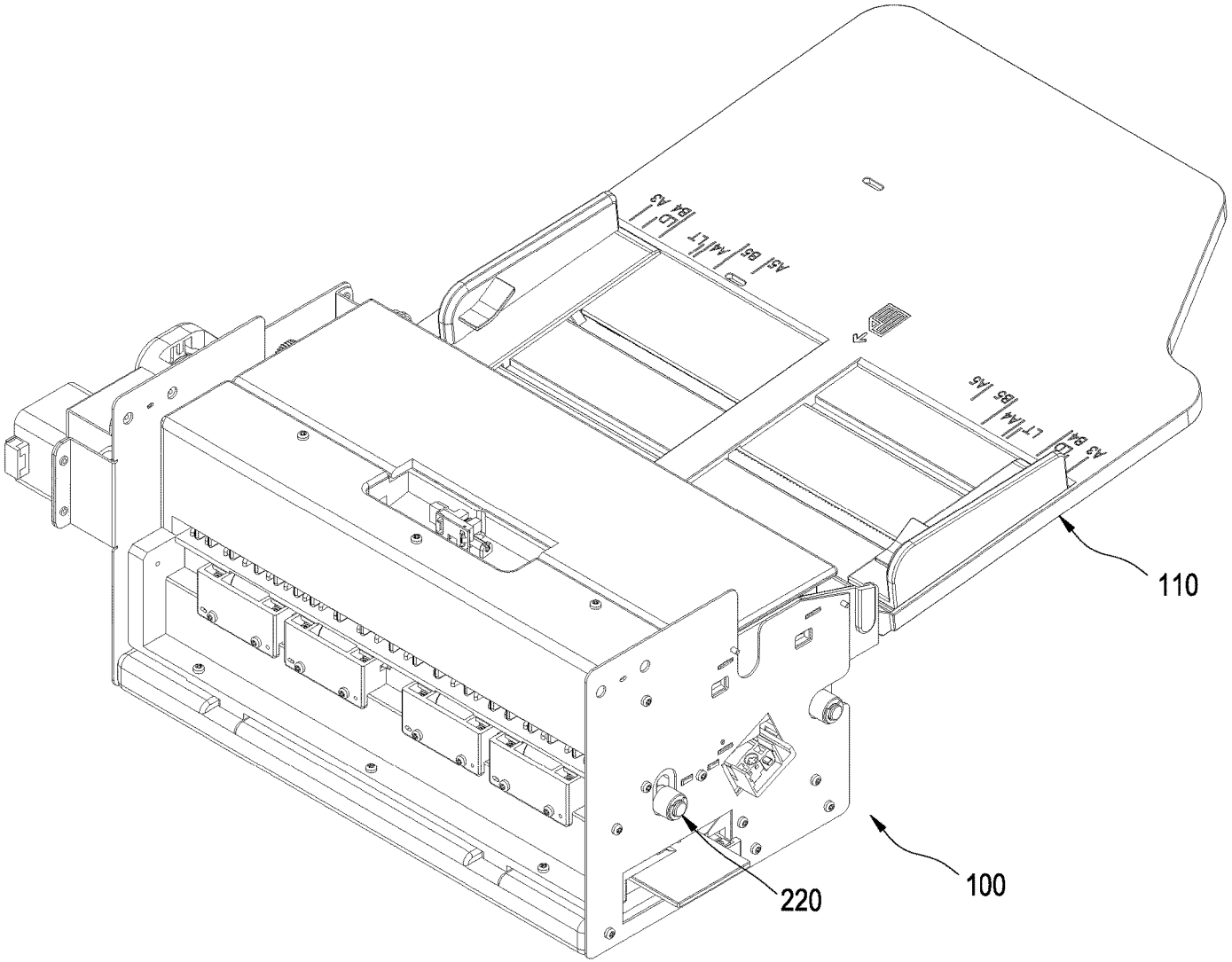
FIG. 1 is a perspective view showing an automatic document feeding device according to this disclosure.

The technical contents of this disclosure will become apparent with the detailed description of embodiments accompanied with the illustration of related drawings as follows. It is intended that the embodiments and drawings disclosed herein are to be considered illustrative rather than restrictive.

According to FIGS. 1 to 6, an embodiment of this disclosure is directed to an automatic document feeding device having a main body 100, a sheet feeding roller assembly 210, a sheet conveying roller assembly 220, a stopping assembly 300, an actuating assembly 400 and a controller 500.

Figure 2:
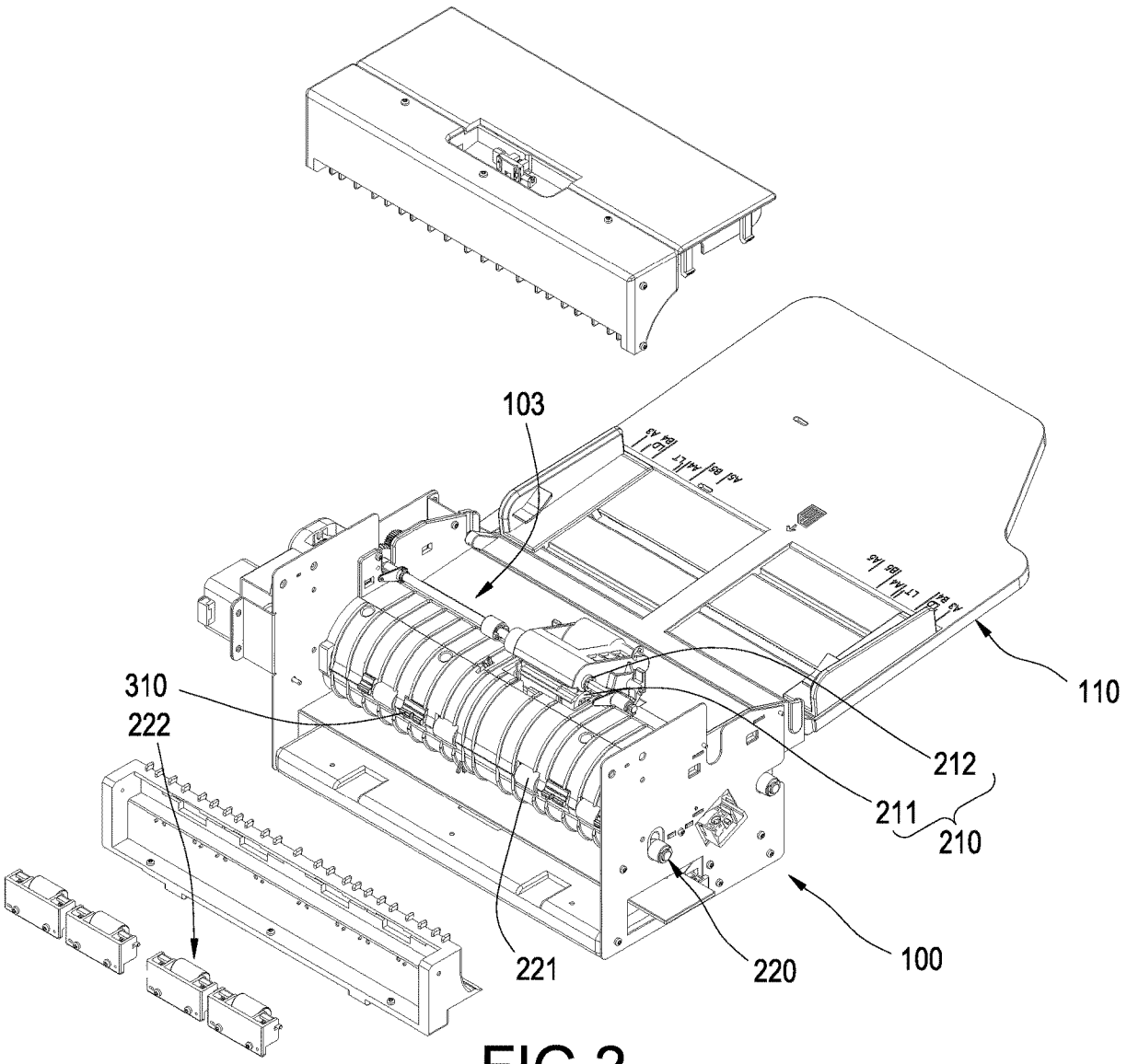
FIG. 2 is an exploded view showing the automatic document feeding device according to this disclosure.
Figure 3:
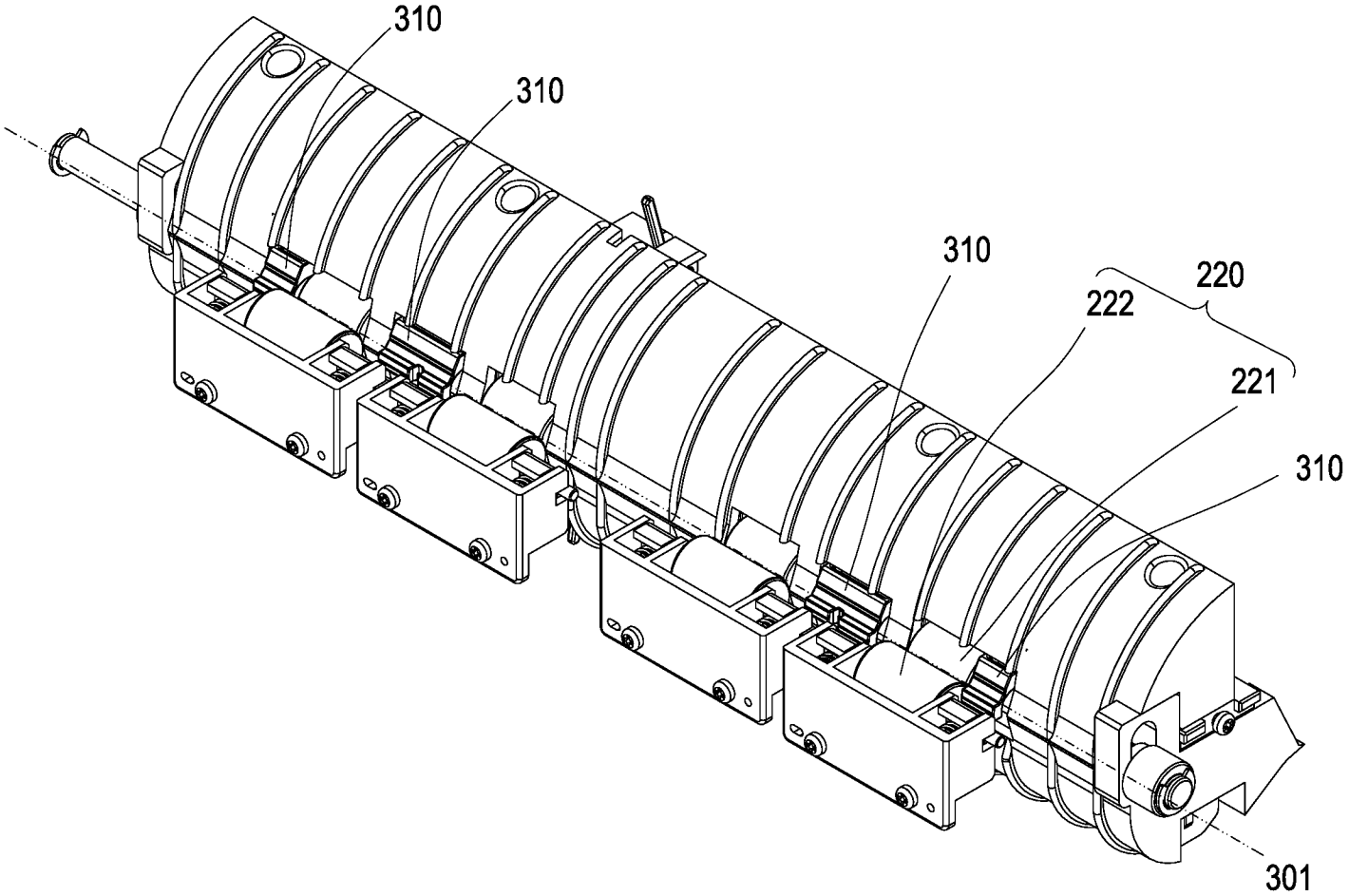
FIGS. 3 to 5 are perspective views showing an arrangement of a sheet conveying roller assembly and a stopping assembly of the automatic document feeding device.
Figure 6:
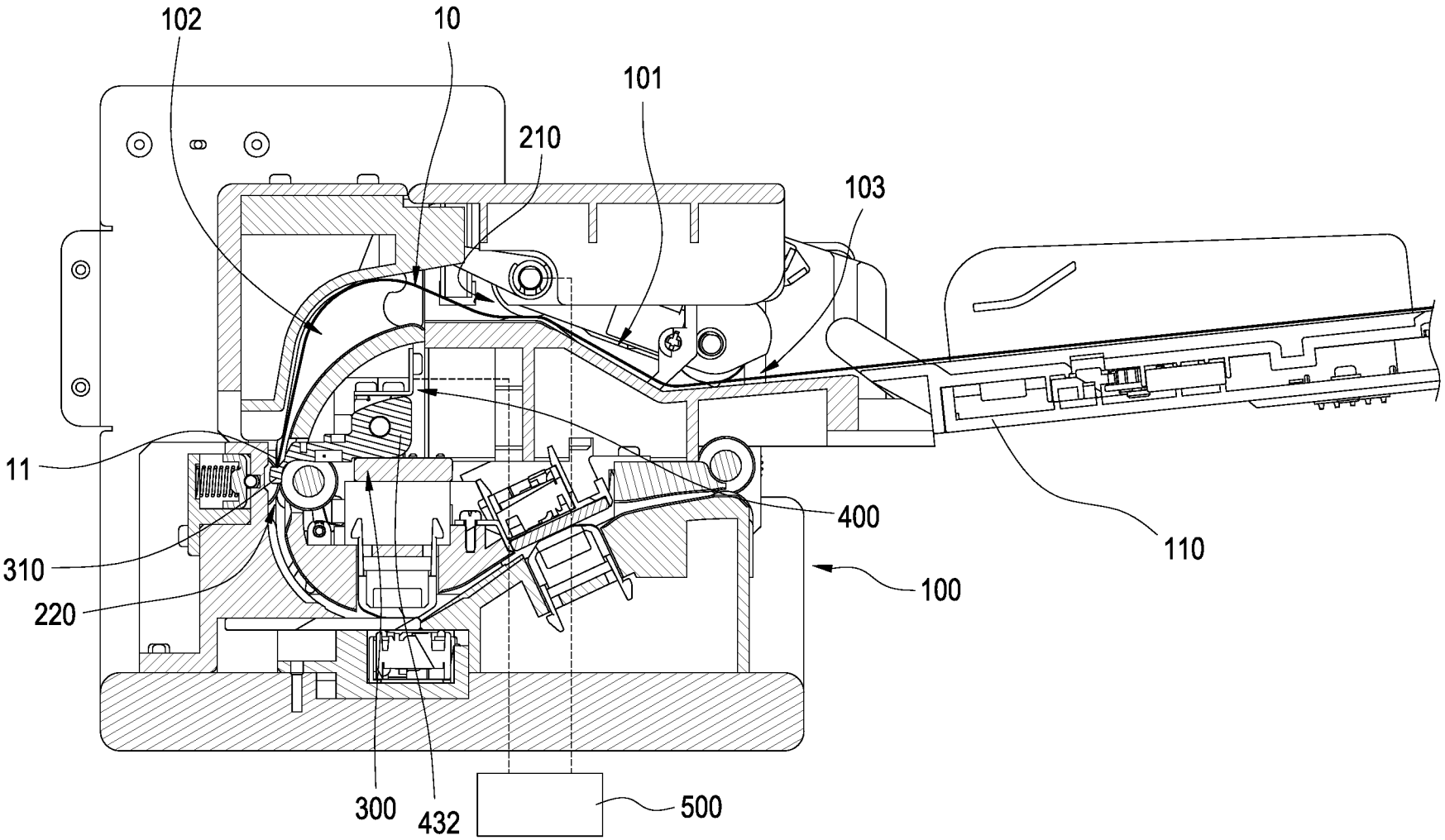
FIGS. 6 and 7 are schematic views showing calibration motions of to the automatic document feeding device according to this disclosure.

According to FIGS. 1, 2 and 6, the main body 100 is generally arranged on a top of a copy machine or a multifunction printer to automatically convey document sheets 10 to the copy machine for scanning. The main body 100 has a sheet conveying channel 101 enclosed and formed therein, and the sheet conveying channel 101 is extended from a top of the main body 100 to a bottom of the main body 100. The sheet conveying channel 101 is a flat slot of a curved shape allowing the document sheets 10 to pass therethrough. The sheet conveying channel 101 has a sheet entrance 103 disposed at one end thereof, according to this embodiment, the sheet entrance 103 is disposed at the top of the main body 100. The main body 100 further has a tray 110 used for carrying the document sheets 10 and connected to the sheet entrance 103. A thickness of a part of the sheet conveying channel 101 is expanded along a normal direction of the curve shape to form a buffering channel 102, and the buffering channel 102 is disposed at a convex side of the sheet conveying channel 101 opposite to a center of curvature of the sheet conveying channel 101. The buffering channel 102 formed by expansion communicates with the sheet conveying channel 101 and is located in front of the stopping assembly 300 to provide an additional space for accommodating a deformation of a sheet blocked by the stopping assembly 300.

The sheet feeding roller assembly 210 is disposed on the main body 100 and a portion of the sheet feeding roller assembly 210 is located in the sheet conveying channel 101. The sheet feeding roller assembly 210 has a feeding driving roller 211 and an idle roller 212 respectively disposed at two opposite sides of the sheet conveying channel 101, and the feeding driving roller 211 is disposed at a concave side of the sheet conveying channel 101 where the center of curvature of the sheet conveying channel 101 is located. Specifically, the sheet feeding roller assembly 210 is disposed between the sheet entrance 103 and the buffering channel 102 along a longitudinal direction of the sheet conveying channel 101. According to this embodiment, the sheet feeding roller assembly 210 is adjacent to the sheet entrance 103, and the feeding driving roller 211 and the idle roller 212 of the sheet feeding roller assembly 210 contact each other, and a contact point between the feeding driving roller 211 and the contacted idle roller 212 is located in the sheet conveying channel 101 for clamping the document sheet 10. The tray 110 is generally tilted so that the document sheets 10 in the tray 110 are falling into the sheet entrance 103, and the document sheet 10 is clamped between the feeding driving roller 211 and the corresponding idle roller 212. The document sheet 10 is fed into the sheet conveying channel 101 through the sheet entrance 103 when the feeding driving roller 211 rotates.

According to FIGS. 2 to 6, the sheet conveying roller assembly 220 is disposed on the main body 100 and a portion of the sheet feeding roller assembly 210 is located in the sheet conveying channel 101. The sheet conveying roller assembly 220 has a conveying driving roller 221 and an idle roller 222 respectively disposed at two sides of the sheet conveying channel 101. Moreover, the conveying driving roller 221 and the idle roller 222 of the sheet conveying roller assembly 220 contact each other and a contact point between the conveying driving roller 221 and the contacted idle roller 222 is located in the sheet conveying channel 101 for clamping and conveying the document sheet 10. The conveying driving roller 221 is disposed at a concave side of the sheet conveying channel 101 where the center of curvature of the sheet conveying channel 101 is located. The conveying driving roller 221 and the feeding driving roller 211 are disposed at the same side of the sheet conveying channel 101, so that the conveying driving roller 221 and the aforementioned feeding driving roller 211 may be connected to a common driving component (e.g., motor) via teeth and driven commonly to simplify the mechanism. Specifically, along the longitudinal direction of the sheet conveying channel 101, the buffering channel 102 is disposed between the sheet feeding roller assembly 210 and the sheet conveying roller assembly 220, and the sheet conveying roller assembly 220 is disposed below the sheet feeding roller assembly 210.

The stopping assembly 300 is arranged on the main body 100, and the stopping assembly 300 is disposed at a concave side of the sheet conveying channel 101 where the center of curvature of the sheet conveying channel 101 is located. The stopping assembly 300 is connected pivotally to the main body 100 and capable of blocking the sheet conveying channel 101. The stopping assembly 300 may be rotated to retreat from the sheet conveying channel 101. Specifically, along the longitudinal direction of the sheet conveying channel 101, the stopping assembly 300 is disposed between the sheet feeding roller assembly 210 and the sheet conveying roller assembly 220 and adjacent to the sheet conveying roller assembly 220. A vertical position of the stopping assembly 300 is between the sheet feeding roller assembly 210 and the sheet conveying roller assembly 220. Moreover, the buffering channel 102 is located between the stopping assembly 300 and the sheet feeding roller assembly 210.

The stopping assembly 300 has a plurality of stoppers 310, and the stoppers 310 may be inserted into the sheet conveying channel 101 via a motion of the stopping assembly 300 so as to block the sheet conveying channel 101. A calibration reference line 301 is defined by an arrangement of the stoppers 310 when the stoppers 310 are located in the sheet conveying channel 101, and the calibration reference line 301 is perpendicular to a longitudinal direction of the sheet conveying channel 101 and extended along a width direction of the sheet conveying channel 101. According to this embodiment shown in FIG. 7, the plurality of stoppers 310 are disposed in the sheet conveying channel 101 in a straight line to define the calibration reference line 301. Moreover, at least two of the stoppers 310 are disposed at two sides of the sheet conveying channel 101. When the document sheet 10 is conveyed in the conveying channel 101, two ends of a leading edge 11 of the document sheet 10 are stopped by the two stoppers 310. When the document sheet 10 is conveyed with a skew state, one end of the leading edge 11 of the document sheet 10 is a leading portion along a conveying direction document sheet 10, and one of the two ends of the leading edge 11 of the document sheet 10 is stopped by the stoppers 310 so as to optimize the calibration.

Figure 4:
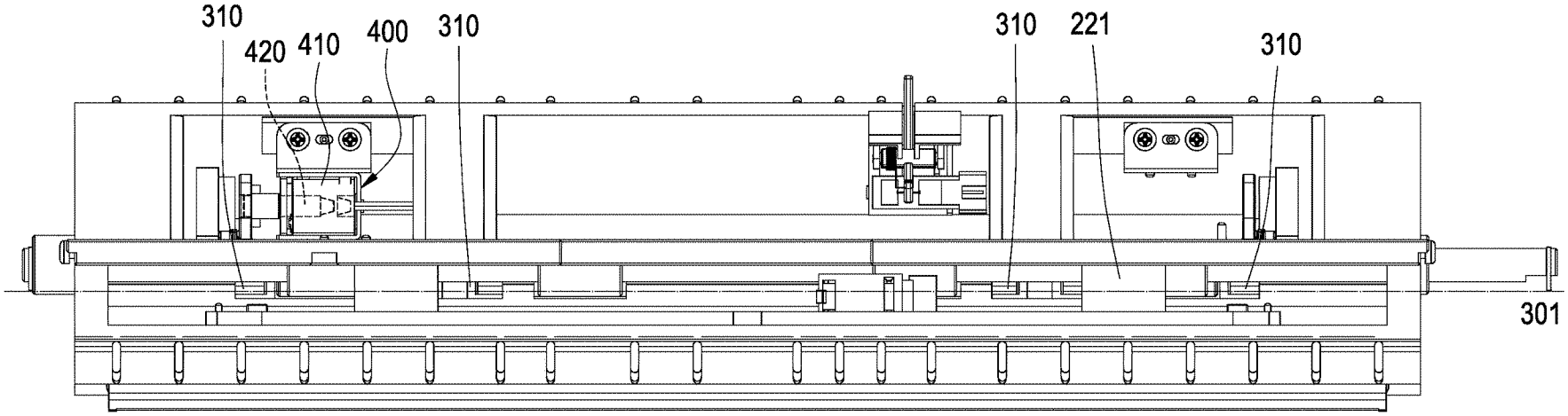
Figure 5:
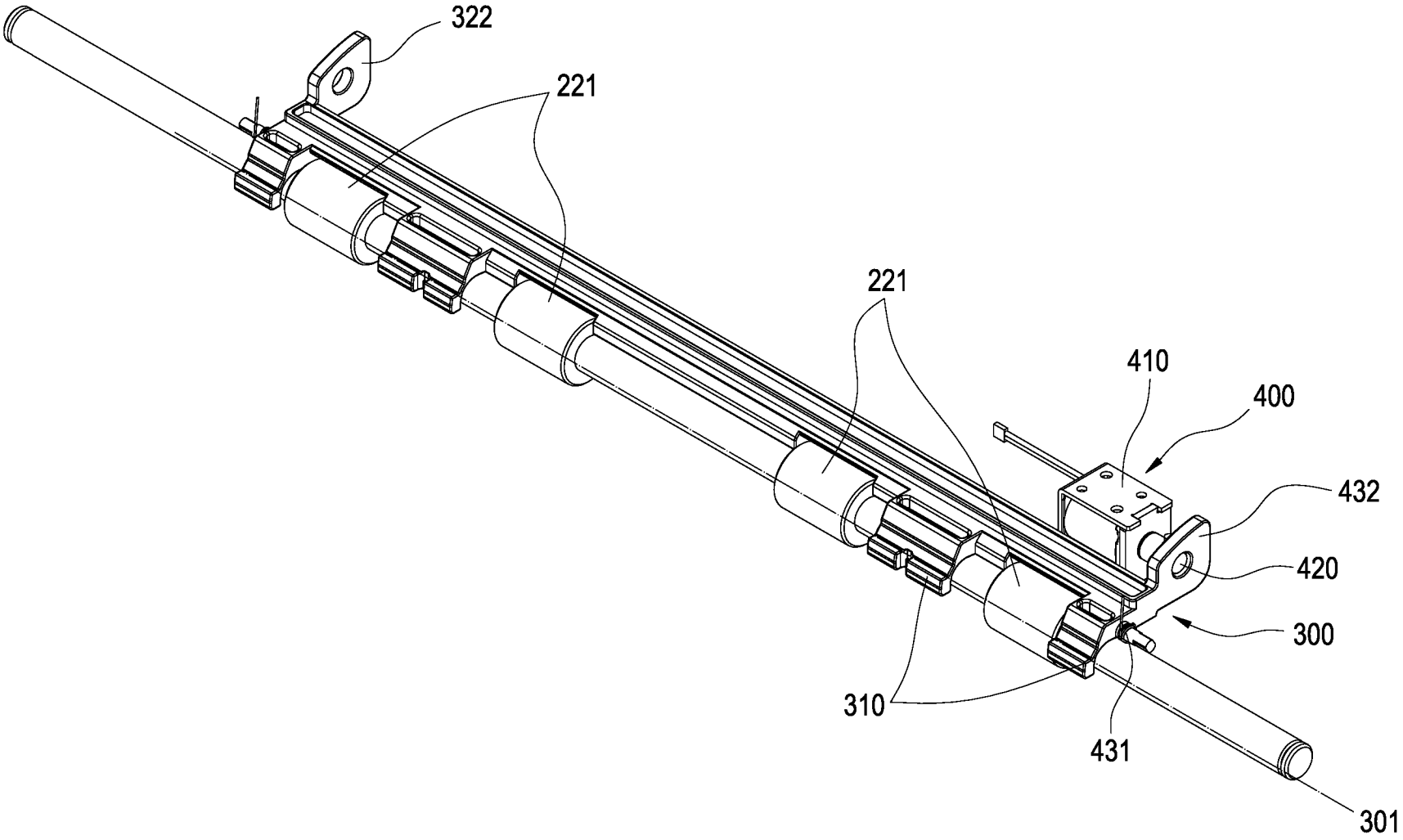

According to FIGS. 4 to 6, the actuating assembly 400 is arranged on the main body 100 corresponding to the stopping assembly 300. According to this embodiment, the stoppers 310 of the stopping assembly 300 are predeterminedly inserted into the sheet conveying channel 101, and the actuating assembly 400 is capable of latching the stopping assembly 300 to fix the stopping assembly 300 at a position for blocking the sheet conveying channel 101. According to this embodiment, the actuating assembly 400 has a solenoid valve 410 and an actuating pin 420, the solenoid valve 410 is connected to the actuating pin 420 so as to actuate the actuating pin 420 to move to latch the stopping assembly 300. This disclosure is not limited to the aforementioned embodiments.

The controller 500 is electrically connected to the actuating assembly 400 and the sheet feeding roller assembly 210, and the type of the controller 500 is not limiting in this disclosure. In general, an embodiment of the controller 500 may be implemented by executing a control program via a customized circuit board. The controller 500 may be disposed on the main body 100, or disposed externally and electrically connected to the actuating assembly 400 and the sheet feeding roller assembly 210 via wires.

Figure 7:
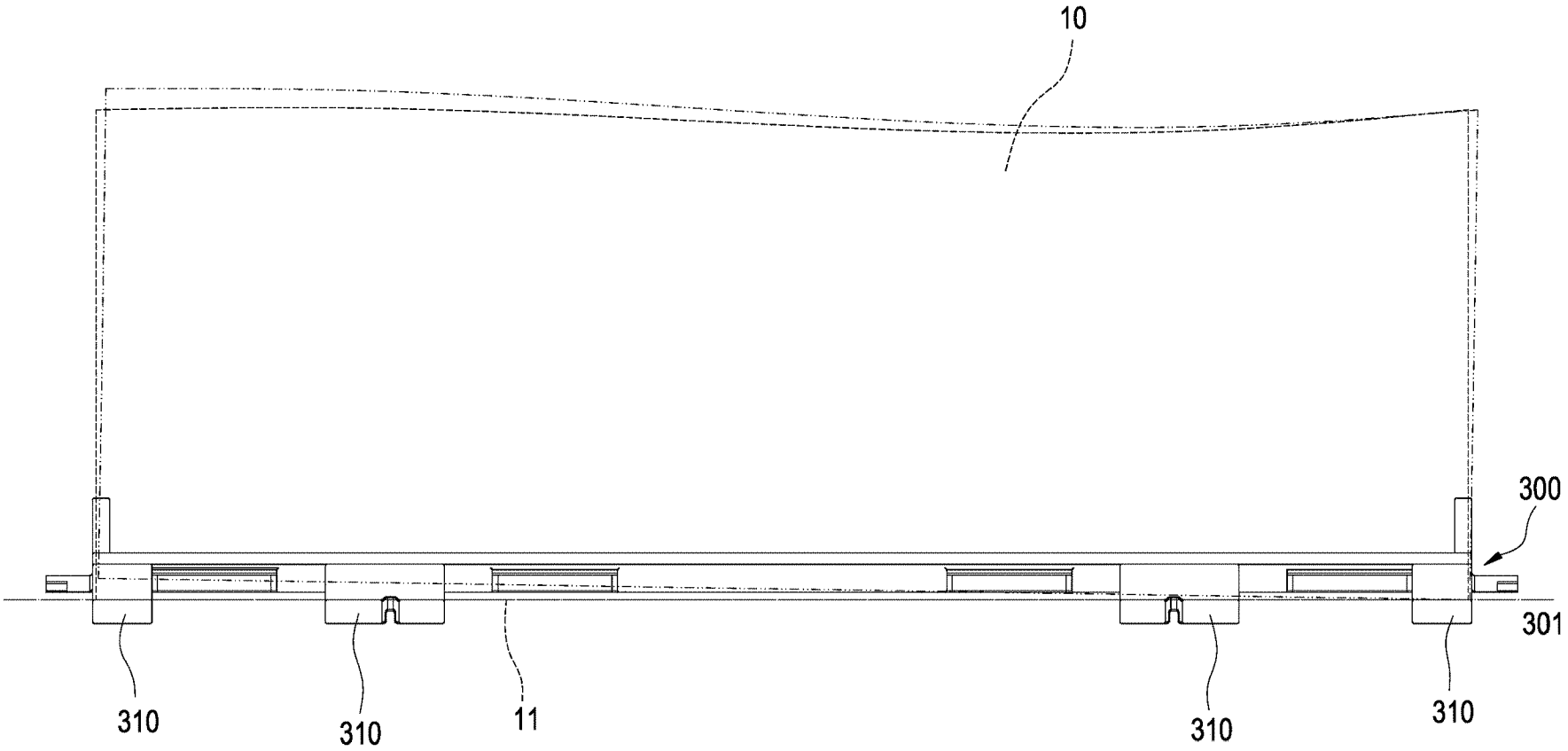
Figure 8:
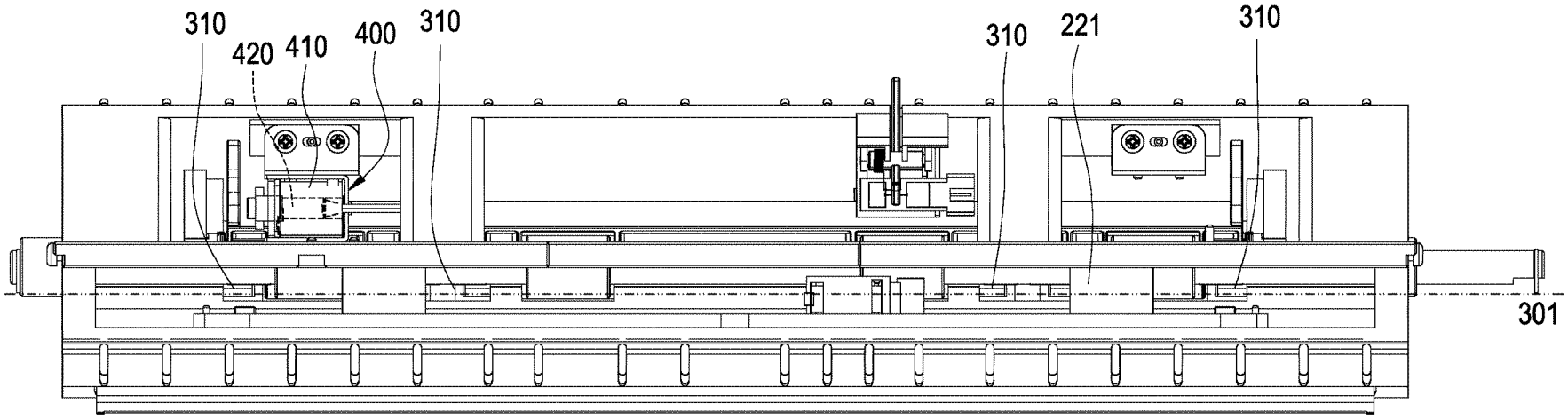
FIGS. 8 to 10 are schematic views showing conveying motions of to the automatic document feeding device according to this disclosure.
Figure 9:
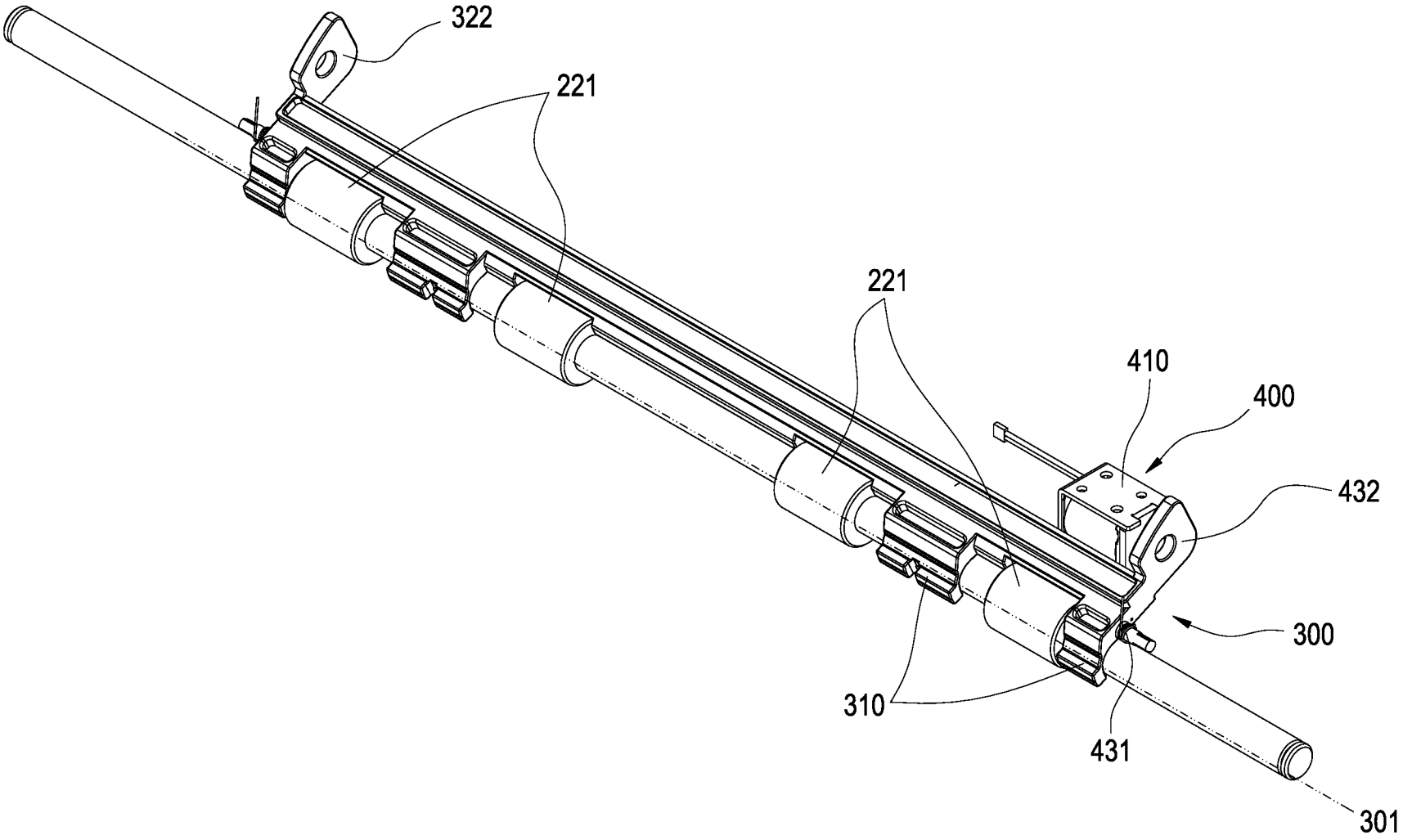
Figure 10:
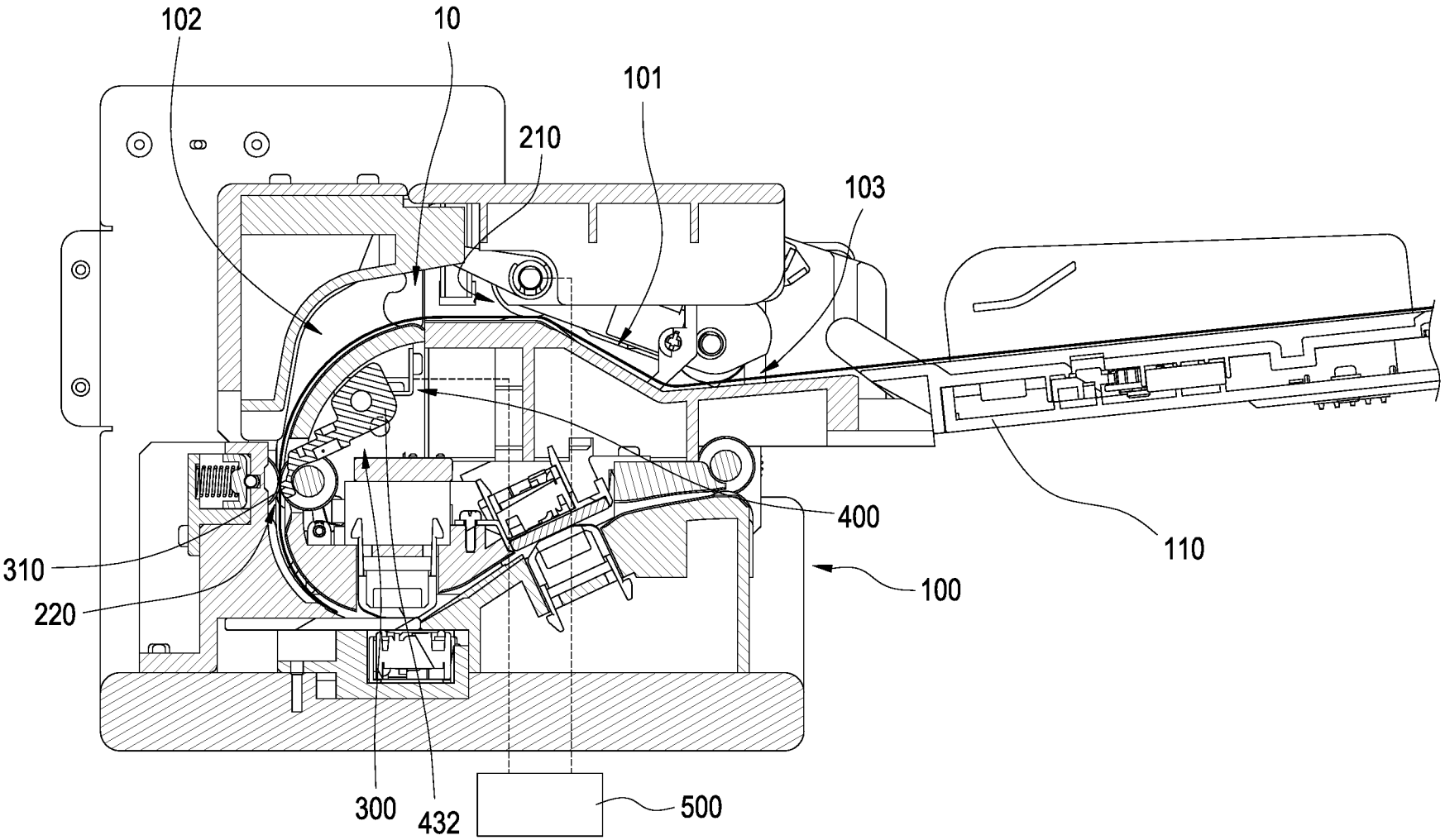

According to FIGS. 5 to 7, the controller 500 controls the actuating assembly 400 to fix the stopping assembly 300 for a predetermined period after actuating the sheet feeding roller assembly 210. The sheet feeding roller assembly 210 keeps feeding the document sheet 10 when the actuating assembly 400 fixes the stopping assembly 300, the leading edge 11 of the document sheet 10 abuts against the stoppers 310 to be aligned and calibrated, and a portion of the document sheet 10 between the leading edge 11 and the sheet feeding roller assembly 210 is pushed by the sheet feeding roller assembly 210 to cause distortion, the buffering channel 102 provides an additional space for the distortion of the document sheet 10 in the sheet conveying channel 101. The stopping assembly 300 is fixed by the actuating assembly 400 during calibrating to avoid positioning deviations. The predetermined period may be defined as a period from the leading edge 11 of the document sheet 10 arriving the stopper 310 to the leading edge 11 being aligned with the calibration reference line 301, and the predetermined period may be estimated according to a feeding speed of the sheet feeding roller assembly 210. According to FIG. 7, specifically, one end of the leading edge 11 of the document sheet 10 firstly contact the stoppers 310 when the document sheet 10 is conveyed with a skew state. The document sheet is continually fed after contacting one of the stoppers 310 and a portion of the document sheet behind the end of the leading edge 11 is distorted, and another end of the leading edge 11 is continually fed to contact another stopper 310. Therefore, the leading edge 11 of the document sheet 10 is aligned to calibration reference line 301.

According to FIGS. 7 to 10, the controller 500 controls the actuating assembly 400 to release the stopping assembly 300 after the leading edge 11 of the document sheet 10 abuts against the stoppers 310 to be aligned with the calibration reference line 301. The scope of this disclosure is not limited to the aforementioned embodiment, the actuating pin 420 of the actuating assembly 400 may be connected to the stopping assembly 300, the controller 500 controls the actuating assembly 400 to hold the stopping assembly 300 for a predetermined period, and then controls the actuating assembly 400 to move the stoppers 310 of the stopping assembly 300 out of the sheet conveying channel 101 by the actuating pin 420. Then, the stopping assembly 300 is pushed out of the sheet conveying channel 101 by an elastic resilience caused by the distortion of the document sheet 10, so that the calibrated leading edge 11 of the document sheet 10 is clamped by the conveying driving roller 221 and the corresponding idle roller 222 for further conveying.

Specifically, a pivotal shaft of the stopping assembly 300 is independent from a pivotal shaft of the sheet conveying roller assembly 220, and motions of the stopping assembly 300 is independent from that of the sheet conveying roller assembly 220 and the sheet feeding roller assembly 210. Accordingly, the conveying motions of the sheet conveying roller assembly 220 and the sheet feeding roller assembly 210 do not influence the calibration motions of the stopping assembly 300, so that the motions of the stopping assembly 300 are stable.

The stopping assembly 300 returns into the sheet conveying channel 101 by the following components after the document sheet 10 passes the sheet conveying channel 101 so as to block the sheet conveying channel 101. In an embodiment, the actuating assembly 400 has an elastic restoring member 431 arranged on the stopping assembly 300, and the elastic restoring member 431 presses on the stopping assembly 300. The elastic restoring member 431 is capable of pushing the stopping assembly 300 back into the sheet conveying channel 101 after the stopping assembly 300 retreats from the sheet conveying channel 101 so as to block the sheet conveying channel 101. According to this embodiment, the elastic restoring member 431 is a spring sheathing the pivotal shaft of the stopping assembly 300, and the elastic restoring member 431 abuts against the main body 100 and the stopping assembly 300.

In another embodiment, the actuating assembly 400 has a gravity restoring member 432 arranged on the stopping assembly 300, the gravity restoring member 432 is capable of pushing the stopping assembly 300 back into the sheet conveying channel 101 after the stopping assembly 300 retreats from the sheet conveying channel 101. The aforementioned component may be used alone or in combination. According to this embodiment, the gravity restoring member 432 is a counterweight structure disposed on a side of the pivotal shaft of the stopping assembly 300 opposite to the stoppers 310.

In another embodiment, the actuating assembly 400 may hold the stopping assembly 300 by the elastic restoring member 431 or the gravity restoring member 432 to make the stoppers 310 of the stopping assembly 300 be predeterminedly located in the sheet conveying channel 101, the actuating pin 420 of the actuating assembly 400 is connected with the stopping assembly 300, the controller 500 is capable of controlling the actuating assembly 400 to move the stoppers 310 of the stopping assembly 300 out of the sheet conveying channel 101 via the actuating pin 420. According to the automatic document feeding device of this disclosure, the stopping assembly 300 is disposed between the sheet feeding roller assembly 210 and the sheet conveying roller assembly 220 and adjacent to the sheet conveying roller assembly 220. The controller 500 controls the actuating assembly 400 to hold the stopping assembly 300 for the predetermined period after actuating the sheet feeding roller assembly 210, and then controls the actuating assembly 400 to release the stopping assembly 300. Therefore, the sheet feeding process and the calibration of the mechanism are controlled together, so the skew of the sheet conveying may be calibrated stably via a simple mechanism.

Figure 11:
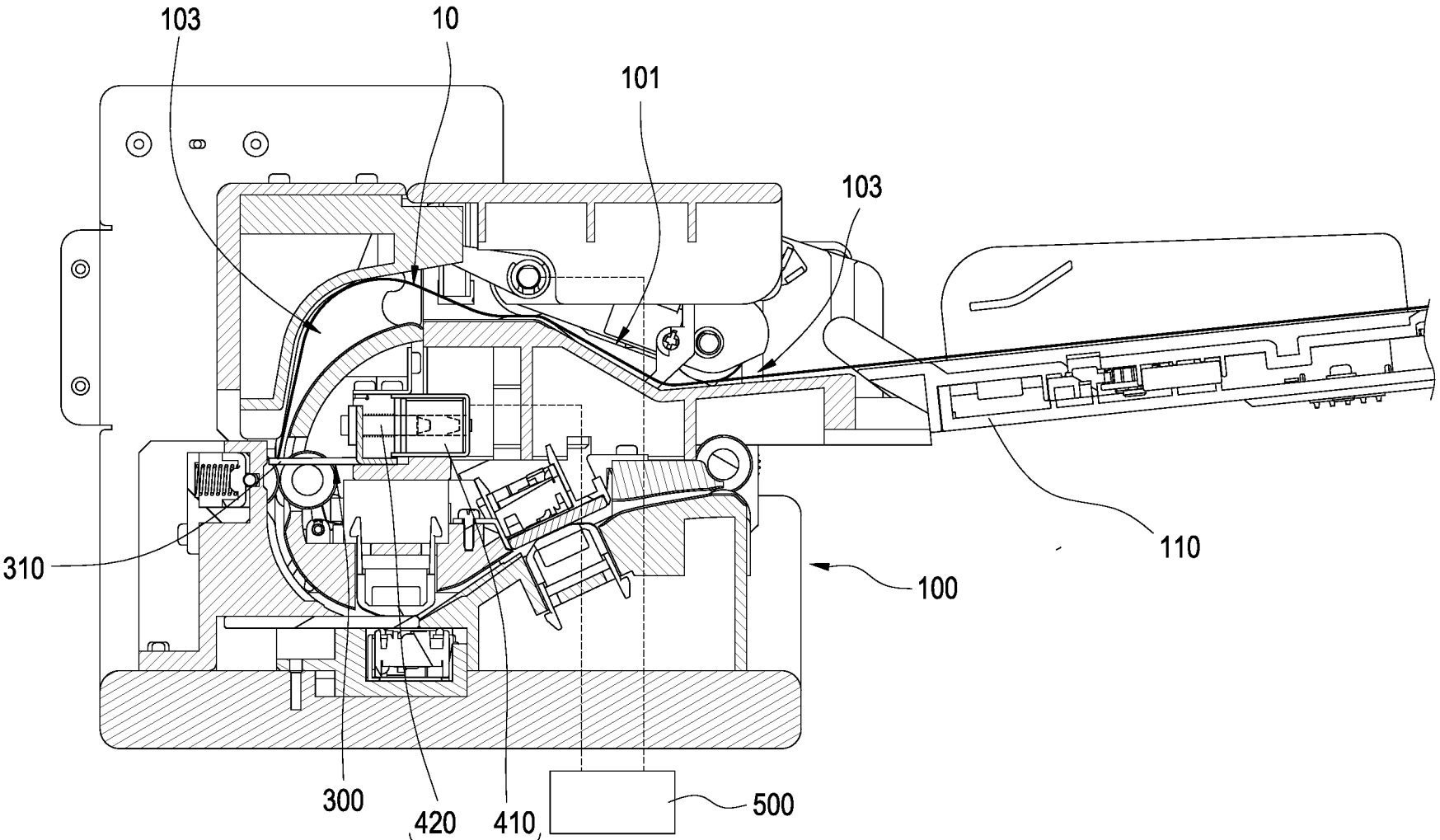
FIGS. 11 to 14 are schematic views of an automatic document feeding device according to another embodiment of this disclosure.
Figure 12:
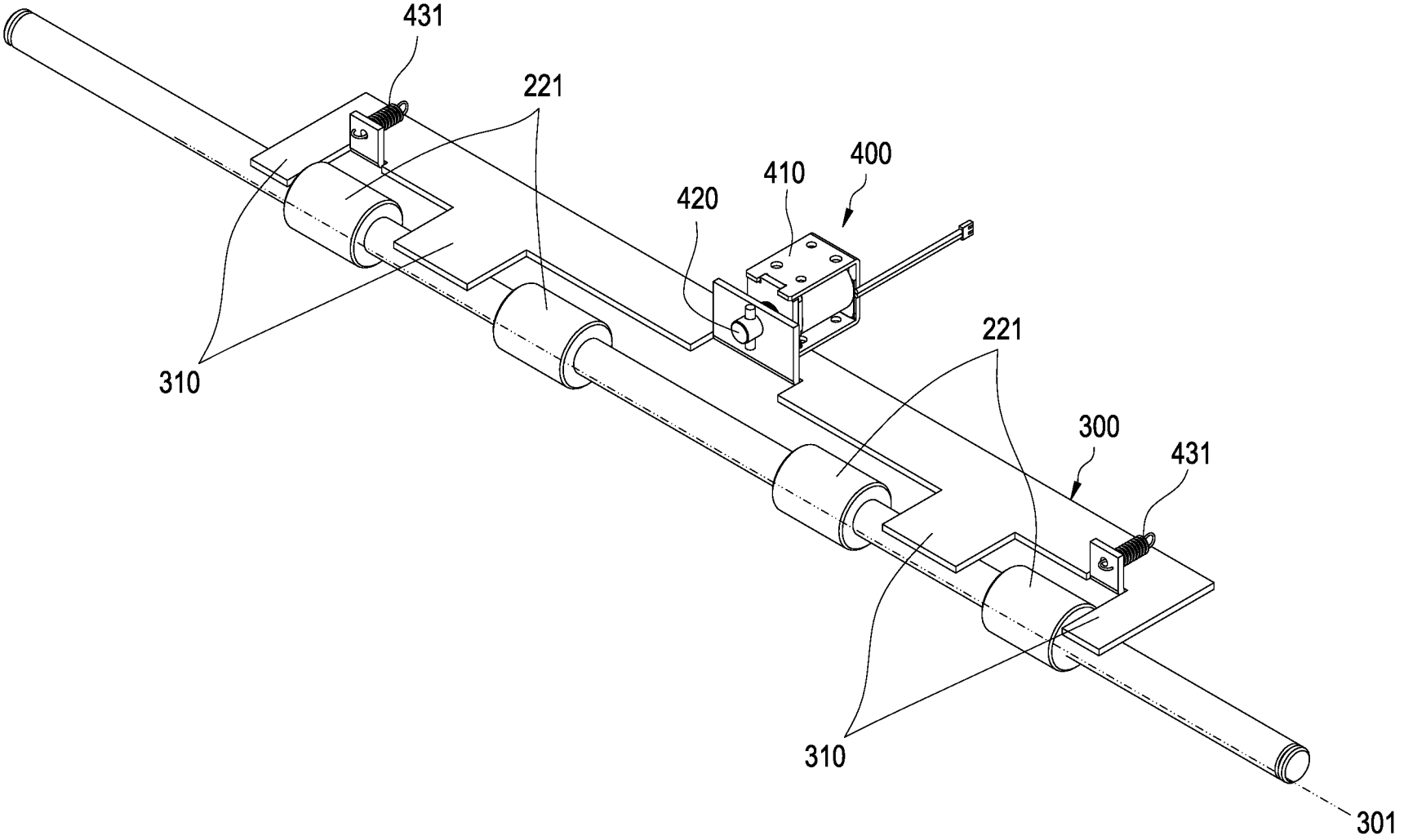

According to FIGS. 11 and 12, another embodiment of this disclosure provides an automatic document feeding device having a main body 100, a sheet feeding roller assembly 210, a sheet conveying roller assembly 220, a stopping assembly 300, an actuating assembly 400 and a controller 500. In this embodiment, the main body 100, the sheet feeding roller assembly 210, the sheet conveying roller assembly 220 and the controller 500 have structures similar to aforementioned embodiment, and here is omitted for brevity. The differences between this embodiment and the aforementioned embodiment are described in detail below.

Figure 13:
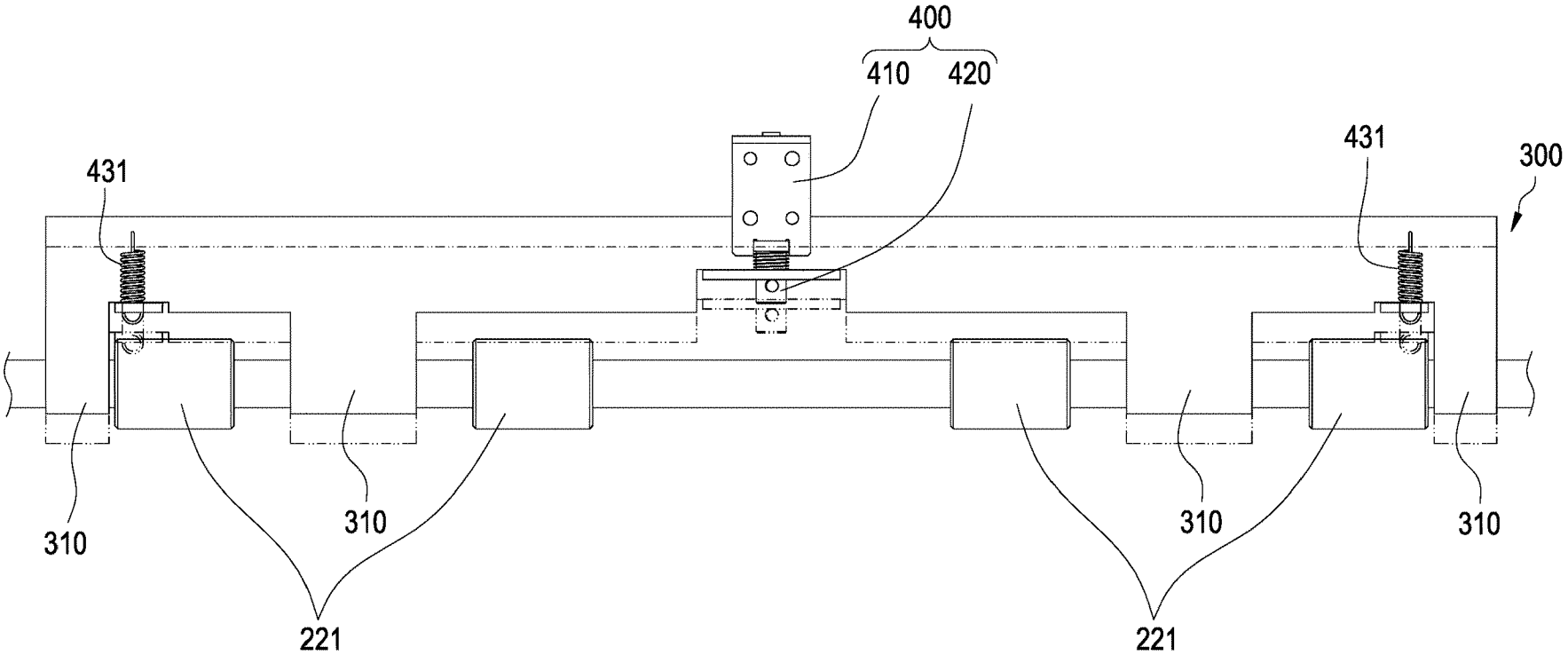
Figure 14:
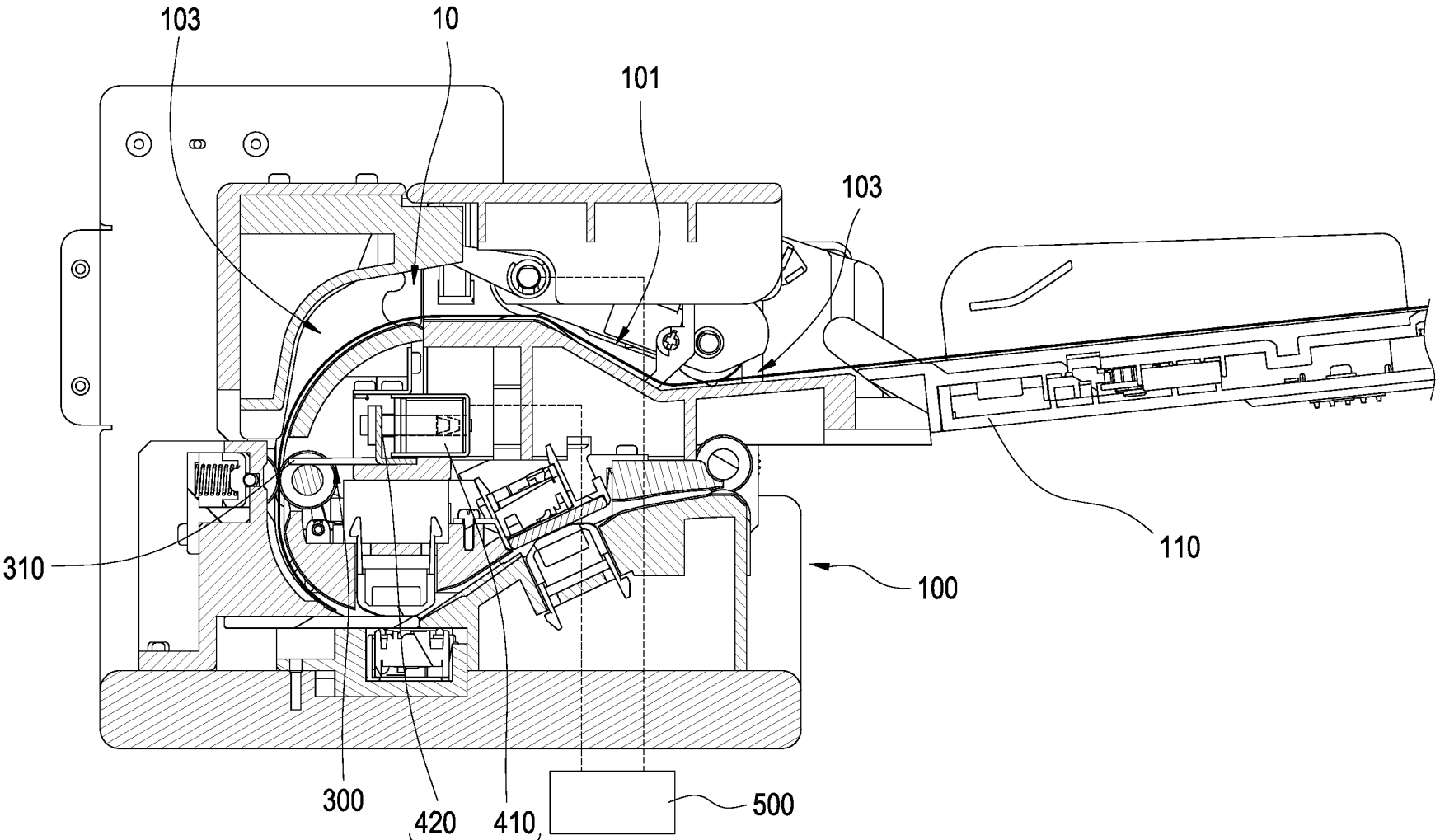

According to this embodiment shown in FIGS. 11, 13 and 14, the stopping assembly 300 is arranged on the main body 100 and capable of moving in the main body 100, the stopping assembly 300 is disposed at a concave side of the sheet conveying channel 101 where the center of curvature of the sheet conveying channel is located. The stoppers 310 of the stopping assembly 300 are predeterminedly located outside the sheet conveying channel 101 as shown in FIG. 14, and the stopping assembly 300 is capable of moving from a position shown in FIG. 13 to another position shown in FIG. 12 so as to block the sheet conveying channel 101.

According to FIGS. 11 and 12, the stopping assembly 300 has a plurality of stoppers 310, the stoppers 310 may be inserted into the sheet conveying channel 101 via a motion of the stopping assembly 300 so as to block the sheet conveying channel 101. A calibration reference line 301 is defined by an arrangement of the stoppers 310 when the stoppers 310 are located in the sheet conveying channel 101. The calibration reference line 301 is perpendicular to a longitudinal direction of the sheet conveying channel 101 and extended along a width direction of the sheet conveying channel 101. According to this embodiment, the plurality of stoppers 310 are disposed in the sheet conveying channel 101 in a straight line to define the calibration reference line 301.

According to this embodiment shown in FIGS. 11 and 12, the actuating assembly 400 is arranged on the main body 100 corresponding to the stopping assembly 300, and the actuating assembly 400 is capable of actuating the stopping assembly 300 to rotate so as to hold the stopping assembly 300 at a position for blocking the sheet conveying channel 101. According to this embodiment, the actuating assembly 400 has a solenoid valve 410 and an actuating pin 420, the solenoid valve 410 is connected to the actuating pin 420 so as to move the actuating pin 420 to shift the stopping assembly 300 to block the sheet conveying channel 101.

According to FIGS. 13 and 14, in an embodiment, an elastic restoring member 431 is arranged on the stopping assembly 300, the elastic restoring member 431 is connected to the stopping assembly 300 and a fixed object (such as any portion of the main body 100 or another fixed component in the main body 100), when the actuating assembly 400 releases the stopping assembly 300, the elastic restoring member 431 holds the stopping assembly 300 to be out of the sheet conveying channel 101. According to this embodiment, the elastic restoring member 431 is a spring connected to the stopping assembly 300, and the elastic restoring member 431 may be compressed to retreat the stopping assembly 300 from the sheet conveying channel 101. The scope of this disclosure is not be limited to the aforementioned embodiment. The actuating assembly 400 may hold the stopping assembly 300 via the elastic restoring member 431 to make the stoppers 310 be predeterminedly located in the sheet conveying channel 101. The actuating pin 420 of the actuating assembly 400 is connected to the stopping assembly 300. The controller 500 is capable of controlling the actuating assembly 400 to move the stoppers 310 of the stopping assembly 300 out of the sheet conveying channel 101 by the actuating pin 420.

While this disclosure has been described by means of specific embodiments, numerous modifications and variations could be made thereto by those skilled in the art without departing from the scope and spirit of this disclosure set forth in the claims.

What is claimed is:

1. An automatic document feeding device, comprising:

a main body, comprising a sheet conveying channel disposed therein, wherein the sheet conveying channel is of a curvature shape, a buffering channel is defined in a manner of a portion of the sheet conveying channel being expanded, and a sheet feeding roller assembly and a sheet conveying roller assembly are respectively arranged at two positions of the sheet conveying channel;

a stopping assembly, arranged between the sheet feeding roller assembly and the sheet conveying roller assembly and adjacent to the sheet conveying roller assembly, movably disposed on the main body and located in the sheet conveying channel or outside the sheet conveying channel, and the buffering channel located between the stopping assembly and the sheet feeding roller assembly;

an actuating assembly, arranged on the main body corresponding to the stopping assembly and configured to move, hold or release the stopping assembly; and a controller, electrically connected with the actuating assembly and the sheet feeding roller assembly, wherein after the controller actuates the sheet feeding roller assembly, the controller controls the actuating assembly to hold the stopping assembly in the sheet conveying channel to block the sheet conveying channel in a predetermined period, and then controls the actuating assembly to stop the stopping assembly from blocking the sheet conveying channel, wherein the buffering channel is defined at a convex side of the sheet conveying channel.

2. The automatic document feeding device according to claim 1, wherein the actuating assembly further comprises an elastic restoring member arranged on the stopping assembly, the elastic restoring member abuts against the stopping assembly, and the stopping assembly is pushed to restore to the sheet conveying channel by the elastic restoring member after the stopping assembly withdraws from the sheet conveying channel.

3. The automatic document feeding device according to claim 1, wherein the actuating assembly further comprising a gravity restoring member arranged on the stopping assembly, and the stopping assembly is pushed to restore to the sheet conveying channel by the gravity restoring member after the stopping assembly withdraws from the sheet conveying channel.

4. The automatic document feeding device according to claim 1, wherein the sheet conveying channel comprises a sheet entrance disposed at one end thereof, the sheet feeding roller assembly is disposed between the sheet entrance and the buffering channel.

5. The automatic document feeding device according to claim 4, wherein the main body comprises a tray connected with the sheet entrance.

6. The automatic document feeding device according to claim 1, wherein the sheet conveying roller assembly is disposed below the sheet feeding roller assembly, and a vertical position of the stopping assembly is between the sheet feeding roller assembly and the sheet conveying roller assembly.

7. The automatic document feeding device according to claim 1, wherein the sheet feeding roller assembly comprises a feeding driving roller and an idle roller adjacent to each other and respectively disposed at two sides of the sheet conveying channel, and the feeding driving roller is disposed at a concave side of the sheet conveying channel.

8. The automatic document feeding device according to claim 1, wherein the sheet conveying roller assembly comprises a conveying driving roller and an idle roller adjacent to each other and respectively disposed at two sides of the sheet conveying channel, and the conveying driving roller is disposed at a concave side of the sheet conveying channel.

9. The automatic document feeding device according to claim 1, wherein the stopping assembly comprises a plurality of stoppers inserted into the sheet conveying channel, a calibration reference line is defined by the stoppers being arranged in the sheet conveying channel when the stoppers are located in the sheet conveying channel, and the calibration reference line is perpendicular to a longitudinal direction of the sheet conveying channel.

10. The automatic document feeding device according to claim 1, wherein the stopping assembly is predeterminedly to be located in the sheet conveying channel, the controller controls the actuating assembly to hold the stopping assembly in the sheet conveying channel for a predetermined period, and then controls the actuating assembly to release the stopping assembly.

11. The automatic document feeding device according to claim 1, wherein the stopping assembly is predeterminedly to be located outside the sheet conveying channel, the controller controls the actuating assembly to move the stopping assembly into the sheet conveying channel and hold the stopping assembly in the sheet conveying channel for a predetermined period, and then controls the actuating assembly to release the stopping assembly.

12. The automatic document feeding device according to claim 1, wherein the controller controls the actuating assembly to hold the stopping assembly in the sheet conveying channel for a predetermined period, and then controls the actuating assembly to move the stopping assembly out of the sheet conveying channel.

13. The automatic document feeding device according to claim 1, wherein the stopping assembly is disposed at a concave side of the sheet conveying channel.

* * * * *